United States Patent [19]

Johnson

[11] Patent Number: 4,746,330

[45] Date of Patent: May 24, 1988

[54] METHOD AND APPARATUS FOR LAPPING REEL MOWERS

[76] Inventor: Curtis D. Johnson, 1019 N. Terrace Dr., Webster City, Iowa 50595

[21] Appl. No.: 72,787

[22] Filed: Jul. 13, 1987

Related U.S. Application Data

[63] Continuation of Ser. No. 819,927, Jan. 17, 1986, abandoned.

[51] Int. Cl.[4] ..... B24B 3/42

[52] U.S. Cl. ..... 51/26; 51/285; 51/247; 56/250; 474/205

[58] Field of Search ..... 51/26, 48 R, 48 HE, 51/50 R, 161, 154, 246, 247, 248, 249, 250, 236, 237 R, 281 R, 285, 288; 56/249, 250; 76/82.1; 474/148, 149, 202, 205

[56] References Cited

U.S. PATENT DOCUMENTS

| | | | |
|---|---|---|---|
| 1,426,409 | 8/1922 | Rawson | 51/236 |
| 1,497,650 | 6/1924 | Mead | 51/26 |
| 1,807,934 | 6/1931 | Ross | 51/26 X |
| 2,204,293 | 6/1940 | Beaver | 51/26 |
| 2,522,960 | 9/1950 | Price | 51/26 |
| 2,554,676 | 5/1951 | Masterson | 51/26 |
| 2,722,780 | 11/1955 | Smith | 51/26 |
| 2,915,853 | 12/1959 | Machovec | 51/26 |
| 3,083,582 | 4/1963 | Wheeler | 474/148 X |
| 3,140,620 | 7/1964 | Ferara | 474/149 X |

FOREIGN PATENT DOCUMENTS

| | | | |
|---|---|---|---|
| 113429 | 8/1968 | Norway | 56/249 |

*Primary Examiner*—Robert P. Olszewski
*Attorney, Agent, or Firm*—Gregory G. Williams

[57] ABSTRACT

The apparatus and method of this invention pertain to the sharpening of the blades of a reel mower having a framework about the reel. The apparatus comprises a belt having protuberances thereon, an assembly of pulleys and a drive motor for driving the belt and guiding the belt and protuberances to engage with the blades of the reel mower. The method of the invention is to use the apparatus of this invention and place it in a position so that, when the belt is revolved about the pulleys, the protuberances engage the blades of the reel mower thereby causing the reel to rotate in an opposite direction from the belt movement.

8 Claims, 2 Drawing Sheets

METHOD AND APPARATUS FOR LAPPING REEL MOWERS

This application is a continuation of application Ser. No. 819,927, filed 1-17-86 now abandoned.

BACKGROUND OF THE INVENTION

1. Field of Invention

The present invention generally relates to an apparatus and method for sharpening reel mowers and more particularly, is concerned with an apparatus and method for lapping reel mowers having a framework about the reel, without removing the ground wheel of the mower or removing the mower gear case cover.

2. Description of Prior Art

Reel-type turfgrass mowers, often used on golf courses, football fields, baseball fields, other sports fields, sod farms, large lawns, and parks etc, are typically drawn with small tractors. These reel mowers are generally operated as a set and are drawn together. A framework usually is associated with the reels enabling them to be drawn together. This framework generally extends above the reel and in front of the reel. These reel mowers frequently need to be sharpened. The sharpening is generally done by lapping or rotating the blades, and applying an abrasive compound to the blades of the reel which abrades with the stationary bedknife of the mower.

Until this invention was designed the sharpening or lapping process was generally done using a machine similar to one as described in U.S. Pat. No. 2,915,853 to F. J. Machovec. The Machovec machine rotated the reel of the mower by the attachment of a rotating shaft to the end of the axel of the reel. This often requires the removal of the ground wheel and the gear case cover of the mower.

The Machovec method has one serious drawback, in that, on some mowers, in order to expose the end of the axel of the reel, the reel mower itself must be partially disassembled. One of the large ground wheels of such mowers must be removed. This exposes a small gear case cover. This gear case cover must also be removed which exposes the end of the axel of the reel for coupling to the Machovec machine and providing the sharpening process. Removal of the gear case cover often causes some of the gear case lubricant to the lost. After the sharpening process is completed, the reel mower must be reassembled and the lost portion of the gear case lubricant replaced.

The disassembly and reassembly process involves considerable energy and a modicum of mechanical ability and is often more time consuming than the actual sharpening process itself.

Another method of lapping the reels of certain mowers has been used. A device similar to one described in U.S. Pat. No. 2,204,293 to H. W. Beaver has been used in the past to lapp reel mowers which are operated by hand. This device involves rotating the reel by engaging its blades with a rotating drum situated in front of the mower. This device is not functional for reel mowers that are drawn by tractors, which typically possess a framework about the reel, because the framework enshrouds the reel from an object the size of the rotating drums of the Beaver machine. Furthermore, the engagement of the blades by such a drum causes a smearing and loss of the abrasive compound.

A need currently exists for improvements in lapping apparatuses, for reel mowers having a framework about the reel, which do not require the removal and replacement of the ground wheel, the removal and replacement of the gear case cover and the concomitant loss and replacement of the gear case lubricant. The primary objective of the present invention is to fullfill the need.

SUMMARY OF INVENTION

The present invention provides for a lapping apparatus to satisfy the aforementioned needs. Using the present invention, the lapping process is carried out without removing and replacing the ground wheel, or removing and replacing the gear case cover, consequently there is no loss of or need to replace, any of the gear case lubricant. Moreover, a person with less mechanical ability would be able to sharpen the reel mower with a substantial savings in time.

Accordingly, the present invention relates to an apparatus, and method for rotating the blades of a reel mower having a framework about the reel in which the apparatus comprises a base, an endless belt having a plurality of protuberences theron, means for guiding the belt and maintaining the engagement of the protuberences with the mower blades when the belt is positioned under the framework of the mower and means for rotating the belt.

The present inventive method involves engaging, under the mower framework, a rotating belt having a plurality of protuberences thereon, with the blades of a reel mower so that the blades are caused to rotate.

DESCRIPTION OF THE PREFERRED EMBODIMENTS

Figure 1:
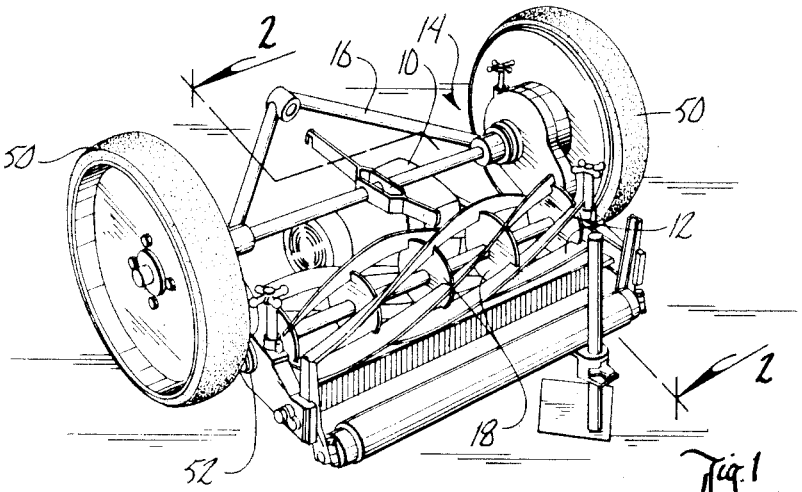
FIG. 1 is a general perspective view of the lapping apparatus of my invention showing it in a position under the framework of the reel mower.
Figure 2:
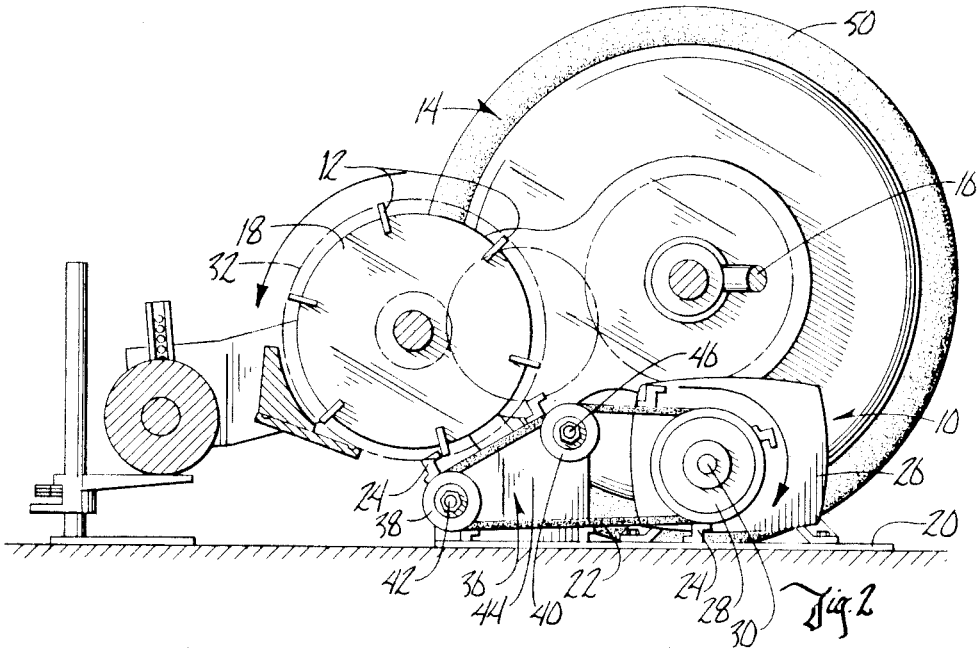
FIG. 2 is a transverse sectional view of line 2—2 of FIG. 1, which further shows the direction of rotation of the reel and the endless belt.
Figure 3:
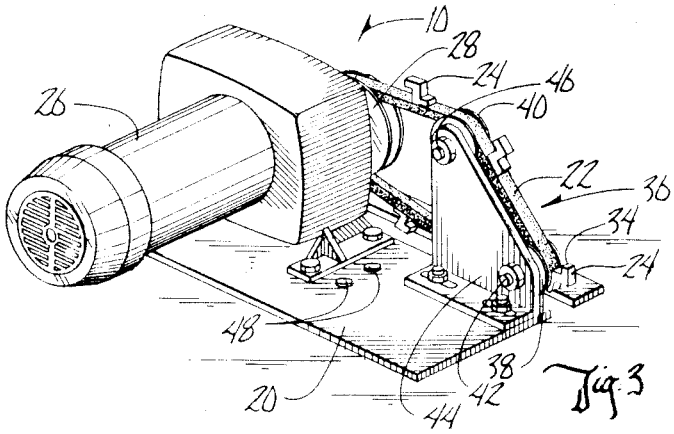
FIG. 3 is a side elevation view of the lapping apparatus of my invention.
Figure 4:
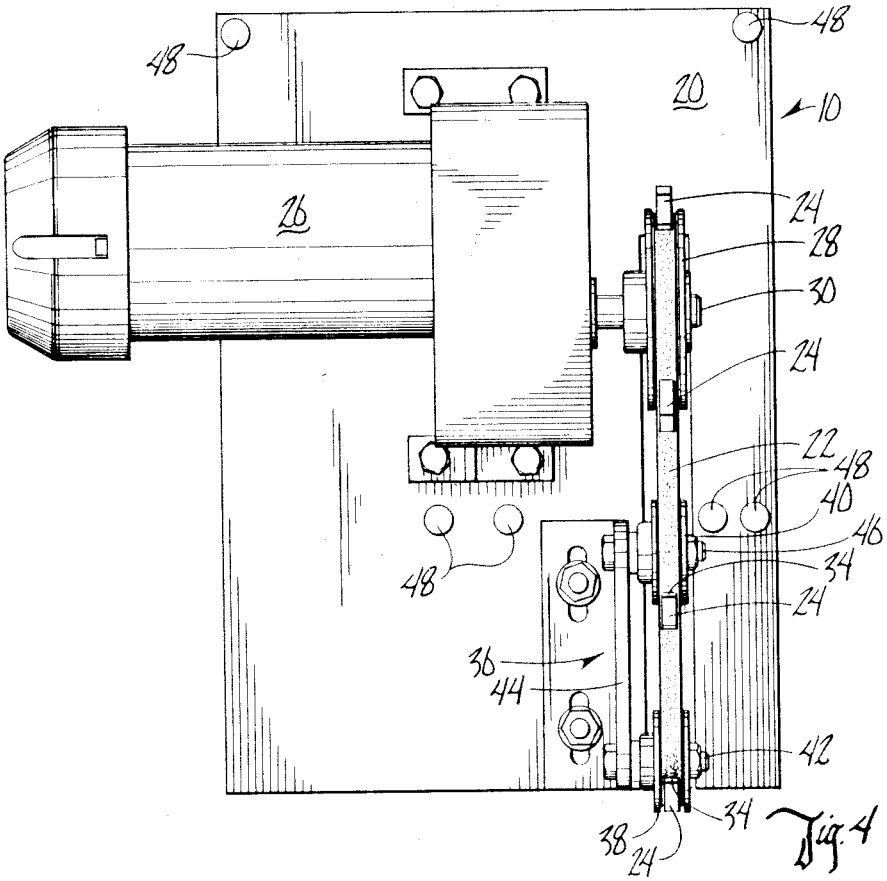
FIG. 4 is a top plan view of the lapping apparatus of my invention.
Figure 5:
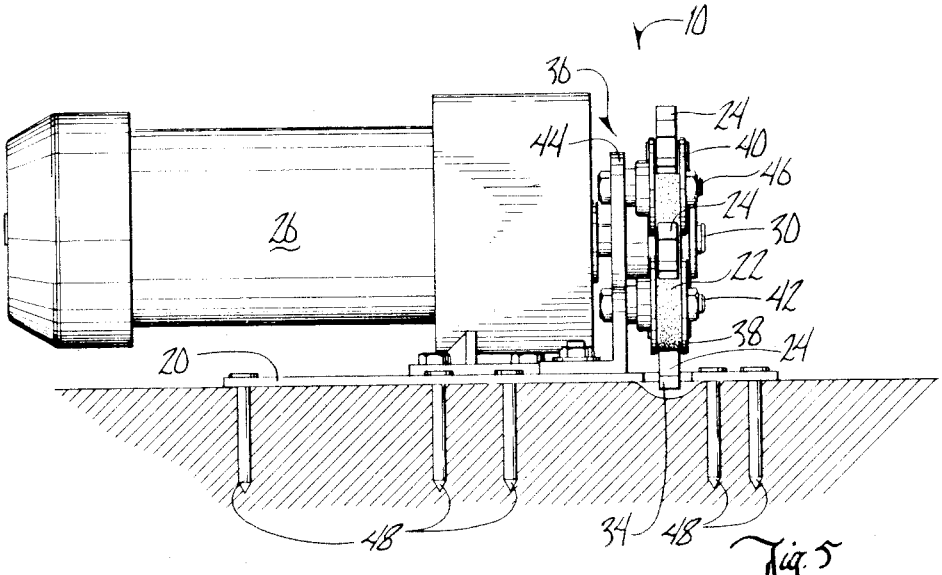
FIG. 5 is a front elevation view of the lapping apparatus of my invention.

Referring now to the drawings, and more particularly to FIG. 1, there is shown an apparatus, generally designated 10, for rotating the blades 12 of a reel mower 14 having a framework 16 about the reel 18. The apparatus 10, basically includes: as shown in FIGS. 2, 3, 4, and 5, a base 20, being preferably a heavy steel plate, an endless belt 22 having a plurality of protuberances 24, a power means 26, being mounted on base 20 in any suitable manner. The power means 26 being preferably a small, reversible electric motor, and a drive pulley 28 being attached thereto. The power means 26, and drive pulley 28, should cooperate with the endless belt 22 at a drive point 30 to produce a belt revolution of preferably 140 rpms. This will create the preferred speed of the reel 18 rotation.

The endless belt 22 being preferably generally flexible yet torsionally rigid and capable of easy attachment of the protuberances 24. The length of the endless belt 22 being preferably approximately equivalent in circumference as the circumference of the outer edge of the reel 18.

The protuberances 24 preferably being equal to the number of blades 12 on the reel 18. The protuberances 24 being preferably made of a durable, yet slightly resilient plastic. The protuberance 24 being attached to the endless belt 22 by any suitable means of attachment. The protuberances 24 having preferably a rectangular leading face 34. The endless belt 22 would preferably be easily detachable for facilitating exchange of a different belt for a different reel.

The guide means 36 preferably being a first guide pulley 38 and a second guide pulley 40. The first guide pulley 38 being mounted at a first point 42 on the vertical extender 44 preferably at lesser height above base 20, than the second guide pulley 40, which is mounted at a second point 46, on the vertical extender 44. The vertical extender 44 being preferably mounted to the base 20 in such a manner as to allow an adjustment in the tension of the endless belt 22 by a translational motion towards or away from the power means 26.

The method of use of the apparatus is as follows:

The apparatus 10 is positioned below the framework 16 of the reel mower 14, and anchored by anchor rods 48, so that the protuberances 24 are in engagement with the blades 12 of the reel 18 as the endless belt 22 is revolved in a first direction around the drive pulley 28, first guide pulley 38, and second guide pulley 40, thereby causing the reel 18 to revolve in a second and opposite direction.

In summary, the apparatus 10 permits the lapping or rotation of the reel 18 of a reel mower 14, which is commonly done to sharpen the blades 12, without the need for removing and replacing the ground wheel 50 and removing and replacing the gear case cover 52.

It is thought that the lapping apparatus and method of the present invention and many of its attendant advantages will be understood from the foregoing description and it will be apparent that various changes may be made in form, construction and arrangement of the parts thereof without departing from the spirit and scope of the invention or sacrificing all of its material advantages, the form herein before described being merely a preferred or exemplary embodiment thereof.

I claim:

1. A lapping apparatus for rotating and sharpening the blades of a reel mower with a framework above and in front of the reel which partially restricts access to the reel in a direction perpendicular thereto, said apparatus comprising in operative combination:

(a) a base;
(b) an endless belt;
(c) a plurality of protuberances, extending radially outward from said endless belt, for engaging the blades;
(d) a guide means, associated with said base, for receiving said endless belt and maintaining said protuberances in engagement with the blades;
(e) a power means associated with said base for rotating said endless belt;
(f) said endless belt being operatively associated with said power means at a drive point and operatively associated with said guide means at a guide point;

wherein said base, guide means, power means and endless belt are arranged so that they are low enough to be slid underneath said framework and below and in front of said reel to allow the protuberances extending from said endless belt to engage the blades of the reel mower from underneath, to cause said blades to rotate in a first direction, when said endless belt is rotated in an opposite direction, whereby the blades of the reel mower are lapped while they rotate.

2. A lapping apparatus as recited in claim 1, in which the guide means comprises; a plurality of pulleys associated with said base.

3. A lapping apparatus as recited in claim 1, in which the guide means comprises:

(a) a first guide pulley, associated with said base for receiving said belt, and maintaining said protuberances in engagement with the blades;
(b) a second guide pulley, associated with said base for receiving said belt, and maintaining said protuberances in engagement with the blades.

4. A lapping apparatus as recited in claim 3, in which said first guide pulley, being associated with said base at a lesser vertical extent from said base in relation to the vertical extent from said base of said second guide pulley, for maintaining engagement of said protuberances with the blades at a position below the framework about the reel.

5. A lapping apparatus as recited in claim 1, wherein said endless belt is operatively associated with said guide means at a guide point for maintaining engagement of said protuberances with the blades at a position below the framework about the reel.

6. A lapping apparatus for rotating the blades of a reel mower having a framework above and in front of the reel which partially restricts access to the reel in a direction perpendicular thereto, to allow sharpening of the blades without removal of the ground wheel of the reel mower, comprising in operative combination;

(a) a base;
(b) an endless belt;
(c) a plurality of separated protuberances, mounted on said endless belt for engagement with the blades;
(d) a first guide pulley, associated with said base for receiving said endless belt;
(e) a second guide pulley, associated with said base for receiving said endless belt;
(f) power means, associated with said belt for rotating said endless belt about said first guide pulley and said second guide pulley;
(g) said endless belt being operatively associated with said first guide pulley at a first point and with said second guide pulley at a second point and operatively associated with said power means at a drive point;

wherein said base, first guide pulley, second guide pulley, power means and endless belt are arranged so that they are low enough to be slid underneath said framework and below and in front of said reel to allow the proturberances extending from the endless belt to engage the blades of the reel mower from underneath, to cause said blades to rotate in a direction opposite the direction of rotation of said endless belt, whereby the blades of the reel mower are lapped while they rotate.

7. A lapping apparatus as in claim 6, wherein said first guide pulley is associated with said base at a lesser vertical extent from said base in relation to the vertical extent of said second guide pulley from said base, for maintaining engagement of said protuberances with the blades at a position below the framework about the reel.

8. A method of rotating and sharpening the blades of reel mowers of the type having a forward and overhood framework situated about the reel which partially restricts access to the reel in a direction perpendicular thereto, said method comprising:

(a) providing a belt having protuberances thereon mounted about guide means on a base and adapted for rotary movement on said guide means in a first direction;

(b) moving said belt, guide means and base underneath said framework and below and forward of said reel and to a position of engagement between at least one of said protuberances and a blade of the reel mower at a point underneath said reel;

(c) rotating said belt in a first direction;

whereby, the blades are caused to rotat in a second direction opposite the direction of said belt wherein the blades are lapped and sharpened while rotated.

* * * * *